US007033484B2

(12) United States Patent
Bacha et al.

(10) Patent No.: US 7,033,484 B2
(45) Date of Patent: Apr. 25, 2006

(54) THERMALLY STABLE BLENDS OF HIGHLY PARAFFINIC DISTILLATE FUEL COMPONENT WITH CONVENTIONAL DISTILLATE FUEL COMPONENT

(75) Inventors: John D. Bacha, Novato, CA (US); Dennis J. O'Rear, Petaluma, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 106 days.

(21) Appl. No.: 10/875,730

(22) Filed: Jun. 25, 2004

(65) Prior Publication Data

US 2006/0049080 A1 Mar. 9, 2006

Related U.S. Application Data

(62) Division of application No. 10/000,585, filed on Oct. 19, 2001, now Pat. No. 6,776,897.

(51) Int. Cl.
*C10L 1/04* (2006.01)

(52) U.S. Cl. ..... 208/14; 208/15; 208/17; 585/1; 585/6; 585/16

(58) Field of Classification Search ..... 208/14, 208/15, 17; 585/1, 6, 16
See application file for complete search history.

(56) References Cited

U.S. PATENT DOCUMENTS

| | | | |
|---|---|---|---|
| 2,310,812 | A | 2/1943 | Schick |
| 3,219,666 | A | 11/1965 | Norman et al. |
| 3,438,757 | A | 4/1969 | Honnen et al. |
| 4,160,648 | A | 7/1979 | Lewis et al. |
| 4,330,302 | A | 5/1982 | Taylor |
| 5,055,625 | A | 10/1991 | Neidiffer et al. |
| 5,349,189 | A | 9/1994 | Maggard |
| 5,621,154 | A | 4/1997 | Wright et al. |
| 5,712,481 | A | 1/1998 | Welch et al. |
| 5,766,274 | A | 6/1998 | Wittenbrink et al. |
| 5,830,244 | A | 11/1998 | Cherpeck |
| 5,849,048 | A | 12/1998 | Cherpeck |
| 5,851,242 | A | 12/1998 | Cherpeck et al. |
| 5,853,436 | A | 12/1998 | Cherpeck |
| 5,865,861 | A | 2/1999 | Cherpeck |
| 5,916,825 | A | 6/1999 | Cherpeck |
| 5,954,843 | A | 9/1999 | Cherpeck |
| 5,993,497 | A | 11/1999 | Cherpeck et al. |
| 6,033,446 | A | 3/2000 | Cherpeck et al. |
| 6,114,542 | A | 9/2000 | Cherpeck |

FOREIGN PATENT DOCUMENTS

| | | | |
|---|---|---|---|
| EP | 187497 | A | 7/1986 |
| GB | 735134 | A | 8/1955 |
| GB | 762136 | A | 11/1956 |
| JP | 60055085 | A | 3/1985 |
| WO | 87/01384 | | 3/1987 |
| WO | WO00/11116 | | 3/2000 |
| WO | WO00/11117 | | 3/2000 |
| WO | 01/83648 | | 11/2001 |

OTHER PUBLICATIONS

Shah, P.P., et al., "Fischer-Tropsch Wax Characterization and Upgrading", Final Report, DOE contract No. AC22-85PC80017, Jun. 6, 1988.

Bacha, J.D., et al., "Diesel Fuel Thermal Stability at 300F", *Proc. Int. Conf. Stabl. Handl. Liq. Fuels*, 2/67HTAD, 1998, 6th International Conference on Stability and Handling of Liquid Fuels, Vancouver, BD, Canada, Oct. 13-17, 1997, 99:671-684.

Shah, P.P., et al., "Fischer-Tropsch Wax Characterization and Upgrading: Final Report", UOP Inc., Des Plaines, IL, Jun. 6, 1988, Work Performed Under Contract No. AC22-85PC80017, pp 6-10, 6-11 and 6-22.

"Diesel Fuel Refining and Chemistry", Technical Review, pp 29 and 30.

Pedley, J.F., et al., "Storage Stability of Petroleum-Derived Diesel Fuel", *Fuel*, 68:28-31 (1989).

GB Search Report dated Dec. 16, 2003, GB 0223208.0.

UK Search Report dated May 29, 2003.

Netherlands Search Report dated Jun. 3, 2003.

ASTM D6468, "Standard Test Method for High Temperature Stability of Distillate Fuels," pp. 1-5, American Society for Testing and Materials, West Conshothocken, PA.

(Continued)

*Primary Examiner*—Tam M. Nguyen
(74) *Attorney, Agent, or Firm*—Buchanan Ingersoll PC

(57) ABSTRACT

A stable distillate fuel blend useful as a fuel or as a blending component of a fuel that is suitable for use in an internal combustion engine, said fuel blend prepared from at least one highly paraffinic distillate fuel component and at least one highly aromatic petroleum-derived distillate fuel component and a process for preparing same involving the blending of at least two components having antagonistic properties with respect to one another.

16 Claims, No Drawings

OTHER PUBLICATIONS

ASTM D4625, Standard Test Method for Distillate Fuel Storage Stability at 43° C. (110° F.), 2000, pp. 1-5, American Society for Testing and Materials, West Conshothocken, PA.

ASTM D2274, "Standard Test Method for Oxidation Stability of Distillate Fuel Oil (Accelerated Method)", 1999, pp. 1-5, American Society for Testing and Materials, West Conshothocken.

ASTM D5304, "Standard Test Method for Assessing Distillate Fuel Storage Stability by Oxygen Overpressure", pp. 1-4, American Society for Testing and Materials, West Conshothocken.

Bacha, J.D., et al., *Diesel Fuel Stability and Instability: A Simple Conceptual Model, IASH 2000, the 7th International Conference on Stability and Handling of Liquid Fuels*, Graz, Austria, Sep. 24-29, 2000, pp. 1-7.

*Gasoline and Diesel Fuel Additivies, Critical Reports on Applied Chemistry*, vol. 25, 1989, pp. 4-27, Published for Society of Chemical Industry by John Wiley & Sons, New York.

Vardi, et al., *Peroxide Formation in Low Sulfur Automotive Diesel Fuels920826, SAE Technical Paper Series: The Engineering Society for Advancing Mobility Land Sea Air and Space Interanational*, International Congress & Exposition Detroit, MI, Feb. 24-28, 1992, Society of Automotive Engineers, Inc.

THERMALLY STABLE BLENDS OF HIGHLY PARAFFINIC DISTILLATE FUEL COMPONENT WITH CONVENTIONAL DISTILLATE FUEL COMPONENT

This application is a divisional of U.S. Ser. No. 10/000,585 filed Oct. 19, 2001, U.S. Pat. No. 6,776,897, which application is incorporated herein by reference in its entirety.

FIELD OF THE INVENTION

The present invention is directed to a thermally stable distillate fuel blend comprising a highly paraffinic distillate fuel component, such as a product derived from the Fischer Tropsch process, and a petroleum-derived distillate fuel component having a high aromatic content and a process for making a stable blend when the components are antagonistic with respect to the other.

BACKGROUND OF THE INVENTION

Distillate fuels which are intended for use in internal combustion engines or jet turbines must meet certain minimum standards in order to be suitable for use. Diesel and jet fuel must have good oxidation stability in order to prevent the formation of unacceptable amounts of deposits which are harmful to the engines in which they are intended to be used. Distillates having very high levels of saturates, such as distillates recovered from the Fischer Tropsch process, have been shown to have excellent cetane numbers and low sulfur contents. Highly paraffinic distillates, as such, appear to be useful for blending with lower quality distillates, such as those with high aromatic contents, to obtain a distillate blend meeting the requirements for its intended application, whether as diesel fuel or jet fuel.

In general, two classes of oxidation stability are of concern in this disclosure. The first is the result of low sulfur levels in the distillate, such as found in Fischer Tropsch distillates and fuels which have been hydrotreated to low sulfur levels. Such hydrocarbons are known to form peroxides which are undesirable because they tend to attack the fuel system elastomers, such as are found in O-rings, hoses, etc. The second source of concern is in the formation of solid deposits as a result of the blending of the different components. For example, it has been found that highly paraffinic distillates, such as Fischer Tropsch products, when blended with highly aromatic petroleum-derived distillates, such as FCC light cycle oil, will result in an unstable blend which forms an unacceptable amount of solid deposits. When a blend of at least two distillate fuel components in some blending proportions result in the formation of unacceptable amounts of deposits as measured by ASTM D6468, the components are described as having "antagonistic properties".

In the case of peroxide formation, it has been suggested that the formation of peroxides in the blends may be controlled by increasing the sulfur content of the blend. See WO 00/11116 and WO 00/11117 which describe the addition of at least 1 ppm sulfur to the blend in order to prevent sulfur formation. This approach has two drawbacks. The first is that this approach does not address the problem associated with the antagonistic properties of the blending components. The second problem is that sulfur in fuels is considered an environmental hazard and it is desirable to reduce the level of sulfur in fuels not increase it.

The present invention is directed to a process for blending highly paraffinic distillate fuel components and petroleum-derived distillate fuel components having high aromatics, the two components having antagonistic properties at certain ratios which result in the formation of unacceptable amounts of solid deposits. The process of the invention also may also be used to reduce the formation of peroxides in the blend without the addition of sulfur. The invention also results in a unique product blend which is suitable for use in internal combustion engines.

BRIEF DESCRIPTION OF THE INVENTION

The present invention is directed to a distillate fuel blend useful as a fuel or as a blending component of a fuel suitable for use in an internal combustion engine, said distillate fuel blend comprising at least one highly paraffinic distillate fuel component having a paraffin content of not less than 70 percent by weight and at least one petroleum-derived distillate fuel component having an aromatic content of not less than 30 percent by weight, wherein the distillate fuel blend has an ASTM D6468 reflectance value of at least 65 percent when measured at 150° C. after 90 minutes. Highly paraffinic distillate fuel components are preferred which have paraffin contents of at least 80 percent by weight, with paraffin contents of more than 90 percent by weight being particularly preferred. Highly paraffinic distillate fuel components suitable for use in carrying out the present invention may be obtained from the oligomerization and hydrogenation of olefins, the hydrocracking of paraffins, or from the Fischer Tropsch process. Distillates recovered from the Fischer Tropsch process are especially preferred for use as the highly paraffinic blending component. The petroleum-derived distillate fuel component may be obtained from refining operations such as, for example, fluidized bed catalytic cracking (FCC and the related TCC process), coking, and pyroysis operations. In the case of the petroleum-derived distillate fuel component, those containing at least 40 percent by weight aromatics are preferred, with aromatic contents of 50 percent by weight or more being more preferred and 70 percent by weight or greater being even more preferred.

The distillate fuel blend composition described herein is suitable for use as a fuel in an internal combustion engine or it may be used as a distillate fuel blend component. As used in this disclosure the term "distillate fuel" refers to a fuel containing hydrocarbons having boiling points between approximately 60° F. and 1100° F. "Distillate" refers to fuels, blends, or components of blends generated from vaporized fractionation overhead streams. In general distillate fuels include naphtha, jet fuel, diesel fuel, kerosene, aviation gas, fuel oil, and blends thereof. A "distillate fuel blend component" refers to a composition which may be used with other components to form a salable distillate fuel meeting at least one of the specifications for naphtha, jet fuel, diesel fuel, kerosene, aviation gas, fuel oil, and blends thereof, especially salable diesel fuel or salable jet fuel, and most especially salable diesel fuel.

As used in this disclosure the term "salable diesel fuel" refers to material suitable for use in diesel engines and conforming to the current version of at least one of the following specifications:

- ASTM D 975—"Standard Specification for Diesel Fuel Oils"
- European Grade CEN 90
- Japanese Fuel Standards JIS K 2204
- The United States National Conference on Weights and Measures (NCWM) 1997 guidelines for premium diesel fuel
- The United States Engine Manufacturers Association recommended guideline for premium diesel fuel (FQP-1A)

The term "salable jet fuel" refers to a material suitable for use in turbine engines for aircraft or other uses meeting the current version of at least one of the following specifications:

ASTM D1655-99.

DEF STAN 91-91/3 (DERD 2494), TURBINE FUEL, AVIATION, KEROSINE TYPE, JET A-1, NATO CODE: F-35.

International Air Transportation Association (IATA) "Guidance Material for Aviation Turbine Fuels Specifications", 4th edition, March 2000

United States Military Jet fuel specifications MIL-DTL-5624 (for JP-4 and JP-5) and MIL-DTL-83133 (for JP-8).

The present invention is also directed to a process for preparing a stable distillate fuel blend comprising at least two components having antagonistic properties with respect to one another, said distillate fuel blend being useful as a fuel or as a blending component of a fuel suitable for use in an internal combustion engine which comprises the steps of (a) blending at least one highly paraffinic distillate fuel component having a paraffin content of not less than 70 percent by weight with at least one highly aromatic petroleum derived distillate fuel component; (b) determining the thermal stability of the blend of step (a) using a suitable standard analytical method; (c) modifying the blending of step (a) to achieve a pre-selected stability value as determined by the analytical method of step (b); and (d) recovering a distillate fuel blend that is characterized by having a reflectance value of at least 65 percent as determined by ASTM D6468 when measured at 150° C. after 90 minutes. As will be explained in greater detail below the modification of blending step (a) as described in step (c) may be accomplished by at least three means. The ratio of the highly paraffinic distillate fuel component to the petroleum-derived distillate fuel component may be adjusted; the boiling range of the highly paraffinic distillate fuel component may be adjusted; or the extent of isomerization of the highly paraffinic fuel component may be adjusted.

ASTM D6468 describes the test to measure distillate fuel thermal stability. It does not set acceptable limits. In setting limits, it is important to consider the entire path from producer to consumer. The fuel must not form deposits in the diesel engine, in the service station, in the regional storage tanks, or during transfer. As part of the present invention, it has been discovered that a minimum acceptable fuel has a reflectance value of 65 percent as measured by ASTM D6468 where the test is conducted at 150° C. for 90 minutes. Even more preferred is a reflectance value of 80 percent or greater. Premium fuel would preferably have a reflectance value of 80 percent at 150° C. for 180 minutes. It should be obvious that fuels having even higher stability as measured by reflectance value would be desirable. Thus the most preferred fuel will have a reflectance value of 90 percent or greater when the test is conducted at 150° C. for 180 minutes. While ASTM D6468 is the preferred test for carrying out the present invention, one skilled in the art will recognize that it may be possible to develop alternative tests which correlate directly with the results of ASTM D6468 when conducted according to the present invention. Therefore, the process of the invention should not be limited to only the use of ASTM D6468 in step (c) but also should include equivalent tests which produce the same or very similar results.

DETAILED DESCRIPTION OF THE INVENTION

The present invention is concerned with the preparation of a unique distillate fuel blend containing at least two distillate components having antagonistic properties relative to one another. The distillate fuel blend of the present invention will contain at least one highly paraffinic distillate fuel component and one petroleum derived distillate fuel component having a high aromatic content. Highly paraffinic distillate fuel components such as used in preparing the compositions of the present invention may be obtained from the oligomerization and hydrogenation of olefins or by the hydrocracking of paraffins, but are most readily available as the product of a Fischer Tropsch synthesis. The highly paraffinic distillate fuel component used to prepare the distillate fuel blends of the present invention will have a paraffin content of not less than 70 percent by weight, preferably not less than 80 percent by weight, and most preferably not less than 90 percent by weight.

The products of Fischer Tropsch processes usually are not suitable for use in distillate fuels due to the presence of olefins and oxygenates. Therefore, further treatment, such as by hydroprocessing, of the Fischer Tropsch products is usually desirable to remove these impurities prior to their use as the highly paraffinic distillate fuel component. Distillate fuels and fuel components prepared from the Fischer Tropsch process by upgrading processes that use hydroprocessing are almost 100 percent saturated, i.e., they are essentially 100 percent paraffinic; and have excellent cetane values of approximately 70. They typically contain low levels of sulfur and other hetroatoms. Unfortunately the low levels of heteroatoms, in particular sulfur, make the Fischer Tropsch distillate fuel component susceptible to the formation of peroxides. In addition the low level of saturates makes blends of the Fischer Tropsch derived fuel with conventional petroleum derived distillate components susceptible to the formation of deposits. Since Fischer Tropsch derived fuel components have an excellent cetane number and very low levels of hetroatoms, it is often viewed as an ideal component for blending with lower quality conventional distillate fuel components. What has not been generally recognized is that blends of Fischer Tropsch derived fuel components when blended with conventional components may be unstable and form unacceptable amounts of deposits. It has also been discovered that that the tendency of distillate fuel blends which contain Fischer Tropsch components to form deposits can be increased significantly when cetane enhancing additives are incorporated into the blend.

The distillate fuel blend will also contain a highly aromatic petroleum-derived fuel blend component which will usually contain at least 30 percent by weight of aromatics, preferably at least 40 percent by weight aromatics, more preferably 50 percent by weight, and most preferably at least 70 percent by weight of aromatics. It should be understood that in preparing the distillate fuel blends of the present invention, it is usually desirable to blend the different components in various proportions to meet certain predefined specifications. In the case of diesel and jet, these specifications include not only those for stability but also those specifications directed to the burning characteristics of the fuel. From an economic perspective, it is desirable to utilize to the fullest extent possible as much of the refinery streams as possible. Therefore, salable jet and diesel fuel is a mixture of various components having different properties which are blended to an average specification which meets the appropriate requirements for the fuel. Highly aromatic petroleum-derived distillates are usually not suitable for use as transportation fuels without either being further refined or blended with other components. A particular advantage of the process of the present invention is that it is possible to use a very highly aromatic petroleum-derived feed stream as a blend stock with a highly paraffinic distillate component to produce a specification fuel blend. Thus while it would normally be desirable to use petroleum-derived components having low or moderate aromatic content as blending stock with highly paraffinic distillate stock to minimize the formation of deposits, the present invention makes it possible to prepare stable blends using highly aromatic petroleum-derived stocks. Accordingly, it should be understood that the higher aromatic contents of the petroleum-derived component is preferred, not because it produces more stable blends, rather it is preferred because the present invention makes it possible for the first time to utilize these highly aromatic components as a blend stock in association with highly paraffinic stocks without further refining and still meet the stability requirements of the fuel. This represents a significant economic advantage.

The highly aromatic distillate component also may be referred to as a non-virgin distillate in order to distinguished it from a virgin distillate, i.e., a distillate which is recovered from petroleum crude by distillation without any significant change in the molecular structure. The highly aromatic distillate component used in preparing the blends of the present invention are recovered from the refining of petroleum-derived feedstocks, such as, by fluidized bed catalytic cracking (FCC and the related TCC process), coking, pyrolysis, and the like. Accordingly, the molecular structure of the highly aromatic petroleum-derived distillate component has been significantly altered during processing, and of particular concern with regard to the present invention, the aromatics content of the component is usually increased. The aromatics content of non-virgin distillates may be reduced by hydrotreating, hydrocracking, hydrofinishing, and other related hydroprocessing operations. FCC light cycle oil is an example of a highly aromatic petroleum-derived distillate fuel blend component which may be used in preparing the fuel compositions which are the subject of the present invention.

The formation of deposits appears to be related to three factors. The factors are the concentration of species that are readily oxidizable, the ability of the blend to keep oxidized products dissolved, and the conditions of the oxidation, such as, temperature, time, moisture, and the presence of oxidation promoters or inhibitors. It has been found that by carefully controlling the blending procedure as determined by certain very specific conditions as exemplified by ASTM D6468, it is possible to significantly reduce the formation of deposits.

One skilled in the art will recognize that the distillate fuel blend of the present invention may include more than just two components. Various distillate blends containing hydrocarbons obtained from petroleum, Fischer Tropsch processes, hydrocracking of paraffins, the oligomerization and hydrogenation of olefins, etc. may be used to prepare the distillate fuel blend of the present invention. In addition, the distillate fuel blend may contain various additives to improve certain properties of the composition. For example, the distillate fuel composition may contain one or more of additional additives, which include, but are not necessarily limited to, anti-oxidants, ignition improvers, dispersants, alkylcycloparaffins, alkylaromatics, and the like.

Anti-oxidants reduce the tendency of fuels to deteriorate by preventing oxidation. A good review of the general field is in Gasoline and Diesel Fuel Additives, Critical Reports on Applied Chemistry, Vol. 25, John Wiley and Sons Publisher, Edited by K. Owen. The particular relevant pages are on 4 to 11. Examples of anti-oxidants useful in the present invention include, but are not limited to, phenol type (phenolic) oxidation inhibitors, such as 4,4'-methylene-bis(2,6-di-tert-butylphenol), 4,4'-bis(2,6-di-tert-butylphenol), 4,4'-bis(2-methyl-6-tert-butylphenol), 2,2'-methylene-bis(4-methyl-6-tert-butyl-phenol), 4,4'-butylidene-bis(3-methyl-6-tert-butylphenol), 4,4'-isopropylidene-bis(2,6-di-tert-butylphenol), 2,2'-methylene-bis(4-methyl-6-nonylphenol), 2,2'-isobutylidene-bis(4,6-dimethylphenol), 2,2'-methylene-bis(4-methyl-6-cyclohexylphenol), 2,6-di-tert-butyl-4-methylphenol, 2,6-di-tert-butyl-4-ethylphenol, 2,4-dimethyl-6-tert-butyl-phenol, 2,6-di-tert-1-dimethylamino-p-cresol, 2,6-di-tert-4-(N,N'-dimethyl-aminomethylphenol), 4,4'-thiobis(2-methyl-6-tert-butylphenol), 2,2'-thiobis(4-methyl-6-tert-butylphenol), bis(3-methyl-4-hydroxy-5-tert-butyl-benzyl)-sulfide, and bis(3,5-di-tert-butyl-4-hydroxybenzyl). Diphenylamine-type oxidation inhibitors include, but are not limited to, alkylated diphenylamine, phenyl-α-naphthylamine, and alkylated-α-naphthylamine. Mixtures of compounds may also be used. Antioxidants are added at below 500 ppm, typically below 200 ppm, and most typically from 5 to 100 ppm.

As noted above, the formation of peroxides in distillate fuel blends may be controlled by the addition of 1 ppm or more of total sulfur. See WO 00/11116 and WO 00/11117 which describe the use of small amounts of sulfur to stabilize blends containing Fischer Tropsch distillates. Normally the highly aromatic petroleum-derived distillate component will contain sufficient sulfur to meet the minimum sulfur requirements necessary to stabilize the final blend. However, in those instances in which the petroleum-derived distillate component contains insufficient sulfur to stabilize the blend, as for example, in those instances in which the petroleum-derived distillate component has been hydrotreated, the addition of sulfur is an option and may be desirable.

Ignition improvers are used to enhance the combustion in the diesel engine. It has also been found that ignition improvers will increase the tendency to form deposits when highly paraffinic components, such as Fischer Tropsch derived components, are present in the blend. When both Fischer Tropsch distillate fuels and ignition improvers are incorporated into the blend, the restrictions on the other components become more stringent or the ignition improver must be selected from the group which does not promote deposit formation. For example, commercially available ignition improvers include 2-ethylhexyl nitrate (2EHN) and di-t-butyl peroxide (DTBP). Normally in convention petroleum derived fuels 2EHN is the ignition improver of choice. However, with Fischer Tropsch distillate fuels DTBP is preferred over 2EHN because 2EHN has been found to promote instability of the fuel while DTBP does not. While it is not desired to limit the present invention to any particular mechanism, it is theorized that the nitrate function is responsible for the instability Accordingly non-nitrate containing ignition improvers are preferred with fuel compositions of the present invention.

Dispersants are additives that keep oxidized products is suspension in the fuel and thus prevent formation of deposits. A good review of the general field is in Gasoline and Diesel Fuel Additives, Critical Reports on Applied Chemistry, Vol. 25, John Wiley and Sons Publisher, Edited by K. Owen. The particular relevant pages are on 23 to 27. Typically for fuel use, detergents can be categorized as amines. The general types of amines are conventional amines such as an amino amide, and polymeric amines such as polybutene succinimide, polybutene amine, and polyether amines. Some examples of specific detergents and dispersants are described in the following patents and references therein: U.S. Pat. Nos. 6,114,542, 6,033,446, 5,993,497, 5,954,843, 5,916,825, 5,865,801, 5,853,436, 5,851,242, 5,848,048, and 5,830,244. Specific detergents and dispersants are also described in:

Derivatives of polyalkenylthiophosphonic acid such as the

Pentaerythritol ester of polyisobutenylthio-phosphonic acid: U.S. Pat. No. 5,621,154

Polybutene succinimides: U.S. Pat. No. 3,219,666

Polybutene amines U.S. Pat. No. 3,438,757

Polyether amines U.S. Pat. No. 4,160,648

Amine dispersants are typically added at below 500 ppm, typically below 200 ppm, and most typically from 20 to 100 ppm as measured as a concentration in the fuel.

The addition of alkylcycloparaffins and alkylaromatics have been found to improve the stability of fuel blends of the present invention. Alkylcycloparaffins are hydrocarbons that contain at least one cycloparaffinic ring (typically a C6 or C5 ring) with at least one attached alkyl group. Alkylcycloparaffins include alkylcyclohexane, alkylcyclopentanes, alkyldicycloparaffins, and alkylpolycycloparaffins. Of these, alkylcyclohexanes and alklycyclopentanes are preferred, with alkylcyclohexanes being especially preferred. Alkylaromatics are hydrocarbons which contain at least one aromatic ring with at least one attached alkyl group. Alkylaromatics include alkylbenzenes, alkylnaphthalenes, alkyltetralines, and alkylpolynuclear aromatics. Of these alkylbenzenes are especially preferred. The exact mechanism by which these additives improve stability is not understood, but it is speculated that they enhance the solvency of the deposits in the fuel blend.

When alkylcycloparaffins are present in the fuel blend, it is desirable that the alkylcycloparaffins be present in an amount of at least 5 percent by weight, preferably more than 10 percent alkylcycloparaffins. Since alkylcycloparaffins can reduce the burning properties of the fuel (the cetane number) the amount of alkylcycloparaffins present should not exceed 50 percent in the distillate fuel blend Preferably the amount of alkylcycloparaffins present will not exceed 30 percent. Generally about 25 percent by weight of alkylcycloparaffins in the fuel blend is the preferred amount. In addition, the number of rings in the alkylcycloparaffins are known to relate to the formation of polynuclear alkylcycloparaffins in the engine exhaust gas. Thus the proportion of alkylcycloparaffins that contain more than one aromatic ring should be kept as low as possible, preferably below 5 percent of the total alkylcycloparaffins present.

Alkylaromatics when present in the distillate blend behave similar to the alkylcycloparaffins already discussed. In general, alkylaromatics should be present in an amount of at least 5 percent by weight and more preferably in an amount of at least 10 percent by weight. Generally an amount in the range of from about 20 percent to about 25 percent by weight is preferred. Higher levels of alkylaromatics tend to be undesirable, since they have a negative effect on the cetane number of the fuel. The amount of alkylaromatics that contain more than one aromatic ring should be held to a minimum to prevent the formation of polynuclear aromatics in the engine exhaust gas.

Distillate fuel blends of the present invention may be used as a blending component of salable distillate fuel intended for use in an internal combustion engine, such as a diesel engine or a spark-ignition internal combustion engine, or in a turbine, such as a jet engine. The distillate fuel blend of the present invention may also be used as a salable fuel without further blending if it meets the appropriate specifications for that application. The fuel compositions of the present invention are particularly useful in preparing fuels for use in diesel engines because of the high cetane value of the highly paraffinic distillate fuel component.

Distillate fuel blend compositions of the present invention are prepared by a process which includes the step of modifying the blending of the various components to achieve a pre-selected stability value. As noted above the minimum acceptable stability value for a fuel blend of the present invention is a reflectance value of at least 65 percent as determined by ASTM D6468 when measured at 150° C. after 90 minutes. Preferably the stability of the distillate fuel blend will exceed this target. As already noted above, certain additives have been shown to affect the thermal stability of the fuel blend as measured by the preferred test method, i.e. ASTM D6468. Aside from the effects of additives, it has been found that several methods may be used to modify the blending step to achieve the target stability value. The blending ratio of the highly paraffinic distillate fuel component and the petroleum derived distillate fuel component may be adjusted; the boiling range of the highly paraffinic distillate fuel component may be adjusted; or the degree of isomerization of the highly paraffinic distillate fuel component may be adjusted. One skilled in the art will recognize that each of the foregoing methods for modifying the blend of the various components are not mutually exclusive. Depending on circumstances, it may be advantageous to utilize any combination of the three methods in preparing the distillate fuel blend.

It is essential to recognize that the test method ASTM D6468 be carried out at a constant temperature of 150° C. Other standard diesel fuel stability test methods are carried out at other temperatures such as 43, 90, and 95° C. Use of other temperature with ASTM D6468 have not been found to satisfactory results.

The stability of the fuel blend is dependent upon the ratio of the highly paraffinic distillate fuel component and the highly aromatic petroleum derived fuel component. Unfortunately, the relationship between stability and the ratio of the different components is complex. It is dependent not only on the ratio between the two or more components, but also on the amount of paraffins and aromatics present. Therefore in order to achieve a acceptable degree of stability, it is important to modify the blending ratios according to the reflectance values obtained from samples taken during the blending process. Some testing is essential to achieve the desired degree of stability, however according to the present invention this should involve only routine testing which is well within the ability of on skilled in the art. In general, when carrying out the process of the present invention, it is preferred that the paraffin content of at least one of the highly paraffinic distillate fuel components present be greater than 80 percent by weight and the aromatic content of at least one of the petroleum-derived fuel components be greater than 50 percent by weight. The effect of the blending ratio will be more clearly understood by reference to the examples below, especially Example 2.

The stability of the fuel blend may also be enhanced by adjusting the boiling range of the highly paraffinic distillate fuel component or by the extent of isomerization of the highly paraffinic distillate fuel component.

The stability the distillate fuel blend may also be improved by reducing the amount of aromatics present in the petroleum-derived distillate fuel component. This may be accomplished by adding another step prior to the initial blending step. Accordingly, the aromatics may be reduced by hydrotreating, by solvent extracting, or by adsorption. These processes are all well known to those skilled in art as useful in lowering the total amount of aromatics present in the distillate and should not require any detailed explanation. However, it should also be understood that these methods for reducing the amount of aromatics present are not mutually exclusive and may be used in various combinations in order to adjust the amount of aromatics present in the petroleum-derived distillate fuel component.

The effect on stability of adding to ignition improvers to the blend is illustrated in Example 3.

The following examples are intended to illustrate specific embodiments of the present invention and to clarify the invention, but the examples should not be interpreted as limitations upon the broad scope of the invention.

EXAMPLES

Example 1

Three different distillate fuel blend components were prepared to illustrate the individual stability of each of the components. A highly paraffinic distillate fuel blend component was generated by reacting synthesis gas over an iron-containing catalyst in a Fischer Tropsch process. The product was separated into a distillate fuel boiling range product and a wax. The distillate fuel blend component was hydrotreated to remove the oxygenates and to saturate the olefins present. The wax was hydrocracked over a sulfided catalyst consisting of amorphous silica-alumina, alumina, tungsten and nickel. A second distillate fuel blend component was recovered from the effluent of the hydrocracker. The two distillate fuel blend components were blended in the proportion of 82% $2^{nd}$ and 18% $1^{st}$ by weight to form the highly paraffinic distillate blend component. Properties of the highly paraffinic distillate fuel blend component blend are shown in Table 1 along with properties of a moderately aromatic, moderately paraffinic distillate blend component (commercial Low Aromatics Diesel Fuel), and a highly aromatic distillate fuel blend component (FCC Light Cycle Oil). In generating the data for the Table, the presence of peroxides in the highly paraffinic distillate fuel blend component was checked and the peroxides were found to be below 1 ppm. Thus formation of peroxides during the course of this work did not influence the values shown in the Table 1.

TABLE 1

| | Blend | | |
|---|---|---|---|
| | A | B | C |
| | Description | | |
| Group Types by Mass Spec, LV % | Highly Paraffinic | Moderately Paraffinic, Moderately Aromatic | Highly Aromatic |
| Paraffins | 94.7 | 38.1 | 9.0 |
| Cycloparaffins | 5.3 | 46.7 | 8.5 |
| Aromatics and Sulfur Types | 0 | 15.2 | 82.5 |
| Stability, ASTM D6468 at 150° C. | | | |
| @ 90 Minutes | 99.8 | 97.8 | 91.4 |
| @ 180 Minutes | 99.7 | 80.9 | 86.0 |

It should be noted that all three components show a high degree of thermal stability. At 90 minutes the reflectance value for each component is in excess of 90%. At 180 minutes the reflectance value for each component is greater than 80 percent.

Example 2

The effect on stability by blending the three components in Various ratios is illustrated in the matrix shown in Table 2. The Test values in the Table represent % reflectance as determined by ASTM D6468 at 150° C.

TABLE 2

| | Blend Percentages | | | 90 Min Results | | | 180 Min Results | | |
|---|---|---|---|---|---|---|---|---|---|
| Blend | A | B | C | $1^{st}$ Test | $2^{nd}$ Test | Avg. | $1^{st}$ Test | $2^{nd}$ Test | Avg. |
| 1 | 100 | 0 | 0 | 99.8 | 99.8 | 99.8 | 99.7 | 99.7 | 99.7 |
| 2 | 0 | 100 | 0 | 97.4 | 98.1 | 97.8 | 81.0 | 80.8 | 80.9 |
| 3 | 0 | 0 | 100 | 91.2 | 91.6 | 91.4 | 85.3 | 86.6 | 86.0 |
| 4 | 95 | 0 | 5 | 94.6 | 95.0 | 94.8 | 84.4 | 84.9 | 84.7 |
| 5 | 95 | 5 | 0 | 99.7 | 99.6 | 99.7 | 99.6 | 99.6 | 99.6 |
| 6 | 5 | 95 | 0 | 98.3 | 98.6 | 98.5 | 82.7 | 83.8 | 83.3 |
| 7 | 0 | 95 | 5 | 98.2 | 98.5 | 98.4 | 84.6 | 86.0 | 85.3 |
| 8 | 5 | 0 | 95 | 90.4 | 90.3 | 90.4 | 85.3 | 88.1 | 86.7 |
| 9 | 0 | 5 | 95 | 91.4 | 91.4 | 91.4 | 85.3 | 84.2 | 84.8 |
| 10 | 90 | 0 | 10 | 91.0 | 90.4 | 90.7 | 75.2 | 75.6 | 75.4 |
| 11 | 90 | 10 | 0 | 99.5 | 99.4 | 99.5 | 98.9 | 98.7 | 98.8 |
| 12 | 10 | 90 | 0 | 98.6 | 98.7 | 98.7 | 84.5 | 83.1 | 83.8 |
| 13 | 0 | 90 | 10 | 97.2 | 97.2 | 97.2 | 90.3 | 89.3 | 89.8 |
| 14 | 10 | 0 | 90 | 90.2 | 89.8 | 90.0 | 83.8 | 82.0 | 82.9 |
| 15 | 0 | 10 | 90 | 90.9 | 91.2 | 91.1 | 83.3 | 83.6 | 83.5 |
| 16 | 70 | 0 | 30 | 83.5 | 84.5 | 84.0 | 65.7 | 66.9 | 66.3 |
| 17 | 70 | 30 | 0 | 98.9 | 98.8 | 98.9 | 95.5 | 95.5 | 95.5 |
| 18 | 30 | 70 | 0 | 98.7 | 98.9 | 98.8 | 89.6 | 88.4 | 89.0 |
| 19 | 0 | 70 | 30 | 93.9 | 93.8 | 93.9 | 79.3 | 80.8 | 80.1 |
| 20 | 30 | 0 | 70 | 87.1 | 87.9 | 87.5 | 72.6 | 71.2 | 71.9 |
| 21 | 0 | 30 | 70 | 91.6 | 91.7 | 91.7 | 78.8 | 77.7 | 78.3 |
| 22 | 50 | 0 | 50 | 84.9 | 85.4 | 85.2 | 64.6 | 66.5 | 65.6 |
| 23 | 50 | 50 | 0 | 98.8 | 98.7 | 98.8 | 92.9 | 93.6 | 93.3 |
| 25 | 0 | 50 | 50 | 91.7 | 91.9 | 91.8 | 75.7 | 74.6 | 75.2 |

It will be noted that blends comprised of the highly paraffinic distillate fuel component (A) and the moderately aromatic, moderately paraffinic distillate fuel component (B) show a predicable near linear relationship between the stability of the resulting blends and the stability of the pure components. When the moderately aromatic, moderately paraffinic distillate fuel component (B) and the highly aromatic distillate fuel component (C) are blended the resulting intermediate compositions are shown to have reduced stability when compared to the pure components. However the decline in stability of the intermediate components is not great. However, when the highly paraffinic distillate fuel component (A) and the highly aromatic distillate fuel component (C) are blended, there is a surprising decline in the stability of the product blends containing 30 to 90 percent of the highly paraffinic distillate fuel blend.

Example 3

The blends of Example 1 were further blended with varying amounts of the ignition improvers 2-EHN and DTBP, and the stability evaluated for each blend by use of the ASTM D6468 test at 150° C. The results are shown in Table 3.

TABLE 3

| Blend | | | Ignition Improver | | 90 Minute results | | 180 Minute results | |
|---|---|---|---|---|---|---|---|---|
| A | B | C | 2-EHN, ppm | DTBP, ppm | 90 Min Avg Value | 90 Min Change | 180 Min Avg Value | 180 Min % Change |
| 199 | 0 | 0 | 0 | 0 | 99.8 | | 99.7 | — |
| 0 | 100 | 0 | 0 | 0 | 98.3 | — | 83.5 | — |
| 0 | 0 | 100 | 0 | 0 | 91.6 | — | 91.8 | — |
| 70 | 0 | 30 | 0 | 0 | 80.3 | — | 67.8 | — |
| 50 | 0 | 50 | 0 | 0 | 78.4 | — | 66.8 | — |
| 100 | 0 | 0 | 1500 | 0 | 99.1 | −0.7 | 99.7 | 0 |
| 0 | 100 | 0 | 1500 | 0 | 77.9 | −20.4 | 46.2 | −37.3 |
| 0 | 0 | 100 | 1500 | 0 | 86.6 | −5.0 | 88.4 | −3.4 |
| 100 | 0 | 0 | 0 | 1725 | 99.5 | −0.3 | 99.6 | −0.1 |
| 0 | 100 | 0 | 0 | 1725 | 98.6 | +0.3 | 73.9 | −9.6 |
| 0 | 0 | 100 | 0 | 1725 | 95.5 | +3.9 | 93.0 | +1.2 |
| 70 | 0 | 30 | 500 | 0 | 55.9 | −24.4 | 51.4 | −16.4 |
| 70 | 0 | 30 | 1500 | 0 | 47.5 | −32.8 | 36.4 | −31.4 |
| 70 | 0 | 30 | 0 | 575 | 64.4 | −15.9 | 60.2 | −7.6 |
| 70 | 0 | 30 | 0 | 1725 | 72.6 | −7.7 | 71.0 | −3.2 |
| 50 | 0 | 50 | 500 | 0 | 56.0 | −22.4 | 48.0 | −18.8 |
| 50 | 0 | 50 | 1500 | 0 | 52.5 | −25.9 | 41.2 | −25.6 |
| 50 | 0 | 50 | 0 | 575 | 60.5 | −17.9 | 53.5 | −13.3 |
| 50 | 0 | 50 | 0 | 1725 | 75.3 | −3.1 | 63.4 | −3.4 |

These results show that the DTBP ignition improver results in a significantly lower decline in thermal stability when compared to the nitrate-containing ignition improver, 2-EHN.

What is claimed is:

1. A distillate fuel blend useful as a fuel or as a blending component of a fuel suitable for use in an internal combustion engine, said distillate fuel blend comprising:

(a) at least one highly paraffinic distillate fuel component having a paraffin content of not less than 70 percent by weight and (b) at least one petroleum-derived distillate fuel component having an aromatic content of not less than 30 percent by weight, wherein the distillate fuel blend has an ASTM D6468 reflectance value of at least 65 percent when measured at 150° C. after 90 minutes.

2. The distillate fuel blend of claim 1 wherein the paraffin content of the highly paraffinic distillate fuel component is not less than 80 percent by weight.

3. The distillate fuel blend of claim 2 wherein the paraffin content of the highly paraffinic distillate fuel component is not less than 90 percent by weight.

4. The distillate fuel blend of claim 1 wherein the aromatic content of the petroleum-derived distillate fuel component is not less than 50 percent by weight.

5. The distillate fuel blend of claim 4 wherein the aromatic content of the petroleum-derived distillate fuel component is not less than 70 percent by weight.

6. The distillate fuel blend of claim 1 further including at least one of an additional component selected from the group consisting of a non-nitrate containing ignition improver, an alklylcycloparaffin-containing blend component, an alkylaromatic-containing blend component, an antioxidant, a dispersant, and any combination thereof.

7. The distillate fuel blend of claim 1 wherein the reflectance value is at least 80 percent.

8. The distillate fuel blend of claim 7 wherein the reflectance value is at least 80 percent when measured at 180 minutes.

9. The distillate fuel blend of claim 8 wherein the reflectance value is at least 90 percent when measured at 180 minutes.

10. The distillate fuel blend of claim 1 further including a peroxide inhibitor.

11. The distillate fuel blend of claim 10 containing 1 ppm or greater of sulfur.

12. The distillate fuel blend of claim 1 wherein the highly paraffinic distillate fuel component is at least partially derived from a Fischer Tropsch process.

13. The distillate fuel blend of claim 1 wherein the reflectance value is at least 80 percent when measured at 150° C. after 90 minutes.

14. The distillate fuel blend of claim 1 wherein the highly paraffinic distillate fuel component is at least partially derived from the oligomerization and hydrogenation of olefins.

15. The distillate fuel blend of claim 1 wherein the highly paraffinic distillate fuel component is at least partially derived from the hydrocracking of paraffins.

16. The distillate fuel blend of claim 1 wherein the petroleum-derived distillate fuel component contains at least 70 percent by weight of aromatics.

* * * * *